US011926977B2

(12) United States Patent
Southworth

(10) Patent No.: US 11,926,977 B2
(45) Date of Patent: Mar. 12, 2024

(54) BRIDGE TRUSS SYSTEM

(71) Applicant: Allied Steel, Lewistown, MT (US)

(72) Inventor: Patrick Southworth, Lewistown, MT (US)

(73) Assignee: Allied Steel, Lewistown, MT (US)

( * ) Notice: Subject to any disclaimer, the term of this patent is extended or adjusted under 35 U.S.C. 154(b) by 92 days.

(21) Appl. No.: 16/195,602

(22) Filed: Nov. 19, 2018

(65) Prior Publication Data

US 2019/0153683 A1 May 23, 2019

Related U.S. Application Data

(60) Provisional application No. 62/599,423, filed on Dec. 15, 2017, provisional application No. 62/589,280, filed on Nov. 21, 2017.

(51) Int. Cl.
*E01D 6/00* (2006.01)
*E01D 101/30* (2006.01)

(52) U.S. Cl.
CPC ..... *E01D 6/00* (2013.01); *E01D 2101/30* (2013.01)

(58) Field of Classification Search
CPC ..... E01D 2101/30; E01D 6/00
See application file for complete search history.

(56) References Cited

U.S. PATENT DOCUMENTS 2,860,743 A * 11/1958 Cliff ..... E04C 3/08 52/692
3,793,790 A * 2/1974 Love ..... E04C 3/40 52/393
4,178,736 A * 12/1979 Salas ..... E04B 1/19 52/653.1
4,275,537 A * 6/1981 Pinson ..... E04C 3/10 52/223.8
4,282,619 A * 8/1981 Rooney ..... E01D 2/04 14/6
4,454,695 A * 6/1984 Person ..... E04B 5/40 52/334
4,489,659 A * 12/1984 Kamohara ..... B66C 23/70 104/107
4,621,475 A * 11/1986 McClain ..... E04C 3/09 52/693
4,653,237 A * 3/1987 Taft ..... E04B 5/40 52/334
4,700,519 A * 10/1987 Person ..... E04B 5/40 52/334
4,729,201 A * 3/1988 Laurus ..... E04D 13/1476 52/334
4,993,094 A * 2/1991 Muller ..... E01D 21/10 14/77.1

(Continued)

OTHER PUBLICATIONS

Acrow Corporation of America, retrieved through the internet archive at http://acrow.com/products-services/bridges/, on Feb. 2, 2015, 3 pages.

(Continued)

*Primary Examiner* — Abigail A Risic
(74) *Attorney, Agent, or Firm* — Rainier Patents, P.S.

(57) ABSTRACT

The description relates to bridge truss systems. On example can include a steel truss that includes a top cord spaced away from a bottom cord and multiple web members secured between the top cord and the bottom cord. A deck can be positioned on the top cord of the steel truss.

3 Claims, 6 Drawing Sheets

(56) References Cited

U.S. PATENT DOCUMENTS

| | | | | |
|---|---|---|---|---|
| 6,634,153 | B1 * | 10/2003 | Peterson | E04C 3/08 52/695 |
| 8,407,966 | B2 * | 4/2013 | Strickland | B21D 47/01 52/650.1 |
| 8,499,511 | B2 * | 8/2013 | Platt | E04B 5/23 14/6 |
| 10,392,803 | B2 * | 8/2019 | Charest | E04B 7/022 |
| 10,480,172 | B2 * | 11/2019 | Ohde | E04B 1/19 |
| 2002/0046534 | A1 * | 4/2002 | Heinly | E04C 3/02 52/693 |
| 2008/0250747 | A1 * | 10/2008 | Johnson | E04C 3/16 52/693 |
| 2013/0283728 | A1 * | 10/2013 | Chang | E04C 3/02 52/846 |
| 2017/0022726 | A1 * | 1/2017 | Sun | E04H 1/04 |
| 2018/0202162 | A1 * | 7/2018 | Charest | E04C 3/291 |
| 2018/0291570 | A1 * | 10/2018 | Lee | E01D 21/065 |

OTHER PUBLICATIONS

Swartz et al., "AASHTO LRFD Bridge Design Specifications provisions for loss of prestress", American Association of State Highway and Transportation Officials, Washington, DC, PCI Journal, Fall 2012, 25 pages.

Attanayake, et al., "First Full-Depth Deck-Panel Accelerated Bridge Construction Project in Michigan: Constructability Challenges and Lessons Learned," Journal of Performance of Constructed Facilities, Sep. 14, 2014, 28(1), pp. 128-135, 8 pages.

Au, et al., "Investigation of Prefabricated Bridge Systems Using Reduced-Scale Models," PCI Journal, Nov. 2008, 53(6), 29 pages.

Battistini, et al., "Improved Cross Frame Details for Steel Bridges," University of Texas at Austin, Austin, TX, May 2014, 411 pages.

Culmo, M.P., "Connection Details for Prefabricated Bridge Elements and Systems," Federal Highway Administration, Washington, DC, Mar. 30, 2009, Publication No. FHWA-IF-09-010, 568 pages.

Culmo, M.P., "Accelerated Bridge Construction—Experience in Design, Fabrication and Erection of Prefabricated Bridge Elements and Systems," Final Manual, Federal Highway Administration, Washington, DC, Nov. 1, 2011, Publication No. HIF-12-013, 347 pages.

Dauner, et al., "The Lully Viaduct, A Composite Bridge with Steel Tube Truss," Journal of Constructional Steel Research, 1998, Paper No. 55, 11 pages.

Fort Miller Company, "Prefabricated Bridge Units," retrieved from the internet archive at http://fortmiller.com/portfolio-item/prefabricated-bridge-units/, on Dec. 8, 2015, 1 page.

Grace et al., "Transverse Post-Tensioning Arrangement for Side-by-Side Box-Beam Bridges," PCI Journal, Spring 2012, 57(2), pp. 48-63, 16 pages.

Hickey, et al., "Live Load Test and Failure Analysis for the Steel Deck Truss Bridge Over the New River in Virginia," Virginia Department of Transportation, Richmond, VA, Final Contract Report No. VTRC 09-CR8, May 2009, 98 pages.

King et al., "Laboratory Load Tests and Analysis of Bailey Bridge Segments," Journal of Bridge Engineering, 2013, 18(10), pp. 957-968, 12 pages.

McDonald, G.S., "The Fatigue Performance of Angle Cross-Frame Members in Bridges, " University of Texas at Austin, May 2009, 193 pages.

Montens et al., "Bringing Bridge Design into the Next Century: The Construction of the Roize Bridge," Modern Steel Construction, Sep. 1992, 32(9), 4 pages.

Muller, J.M., "Bridge to the Future," Civil Engineering, ASCE, Reston, VA, Jan. 1993, 5 pages.

Structural Design and Rehabilitation, Inc., "Prefabricated Steel Bridge Systems," Federal Highway Administration, Washington, DC, 2005, No. DTFH61-03-R-00113, 261 pages.

U.S. Bridge, "We Get It Done Right," retrieved through the internet archive at http://www.usbridge.com/whyusbridge, on Sep. 30, 2015, 3 pages.

Austin et al., "Emulating Cast-in-Place Detailing in Precast Concrete Structures," ACI-ASCE Committee 550 Report, Farmington Hills, MI, 2001, 16 pages.

Klaiber et al., "Alternative Solutions to Meet the Service Needs of Low Volume Bridges in Iowa," Iowa Department of Transportation and Iowa State University, Aimes, IA, Jun. 2004, 203 pages.

Montana Department of Transportation, "Montana Trucker's Handbook," 2004, 58 pages.

Montana Department of Transportation, "Allied Steel Modular Steel Beam Bridge with Precast Concrete Deck," retrieved from the internet archive at: https://www.mdt.mt.gov/other/webdata/external/research/docs/epsl/maxwell/workplan.pdf, Jun. 2012, 2 pages.

Fick et al., "Investigation of Prefabricated Steel-Truss Bridge Deck Systems," Montana Department of Transportation, Project Summary Report 8226-001, Nov. 2017, 4 pages.

Fick et al., "Investigation of Prefabricated Steel-Truss Bridge Deck Systems," Montana Department of Transportation, Final Report 8226-001, Nov. 2017, 71 pages.

* cited by examiner

BRIDGE TRUSS SYSTEM

PRIORITY

This utility patent application claims priority from U.S. Provisional Patent Application 62/589,280, filed on 2017 Nov. 21 and from U.S. Provisional Patent Application 62/599,423, filed on 2017 Dec. 15, which are hereby incorporated by reference in their entirety.

BRIEF DESCRIPTION OF THE DRAWINGS

The accompanying drawings illustrate implementations of the concepts conveyed in the present application. Features of the illustrated implementations can be more readily understood by reference to the following description taken in conjunction with the accompanying drawings. Like reference numbers in the various drawings are used wherever feasible to indicate like elements. Further, the left-most numeral of each reference number conveys the Figure and associated discussion where the reference number is first introduced.

DETAILED DESCRIPTION

The present description relates to a prefabricated steel truss girder bridge deck system (e.g., "bridge truss system"). The bridge truss system can employ steel trusses in a deck-over configuration where the deck is positioned over the steel trusses. Deck-over bridges can be completed faster than other bridge types. Further, deck-over bridges can require less depth under the deck than other bridge configurations and do not require any structural members above the bridge deck. Traditionally, solid steel girders have been employed in deck-over configurations. However, the steel girders are expensive from a materials perspective for a given load carrying bridge capacity. Despite decades of investigation and billions of dollars involved, no viable alternatives were developed. The present concepts provide deck-over steel truss construction that is fast to complete, strong, and relatively less expensive than existing solutions.

Figure 1A:
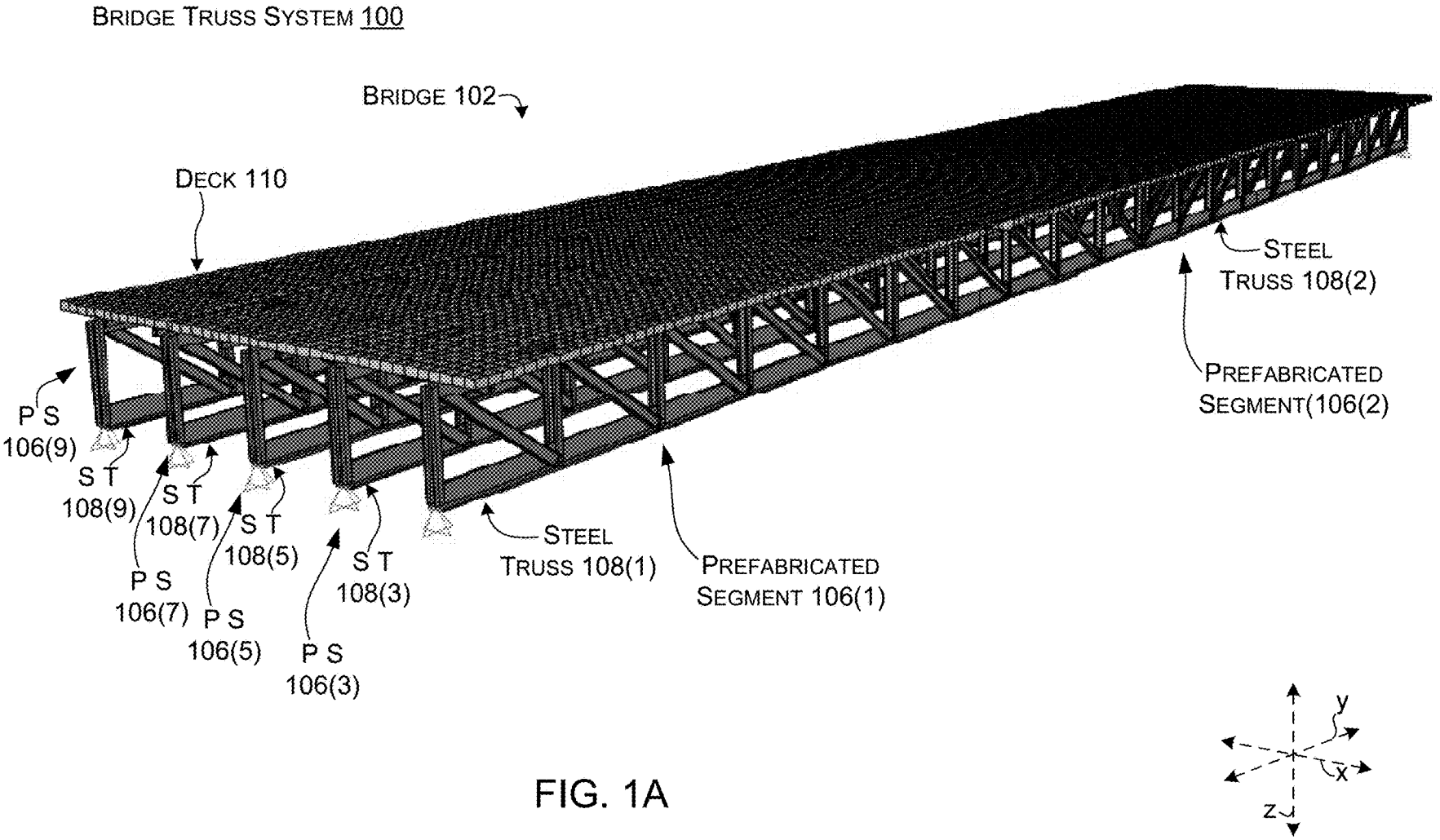
FIG. 1A shows a perspective view of a bridge truss system example in accordance with some implementations of the present concepts.
Figure 1B:
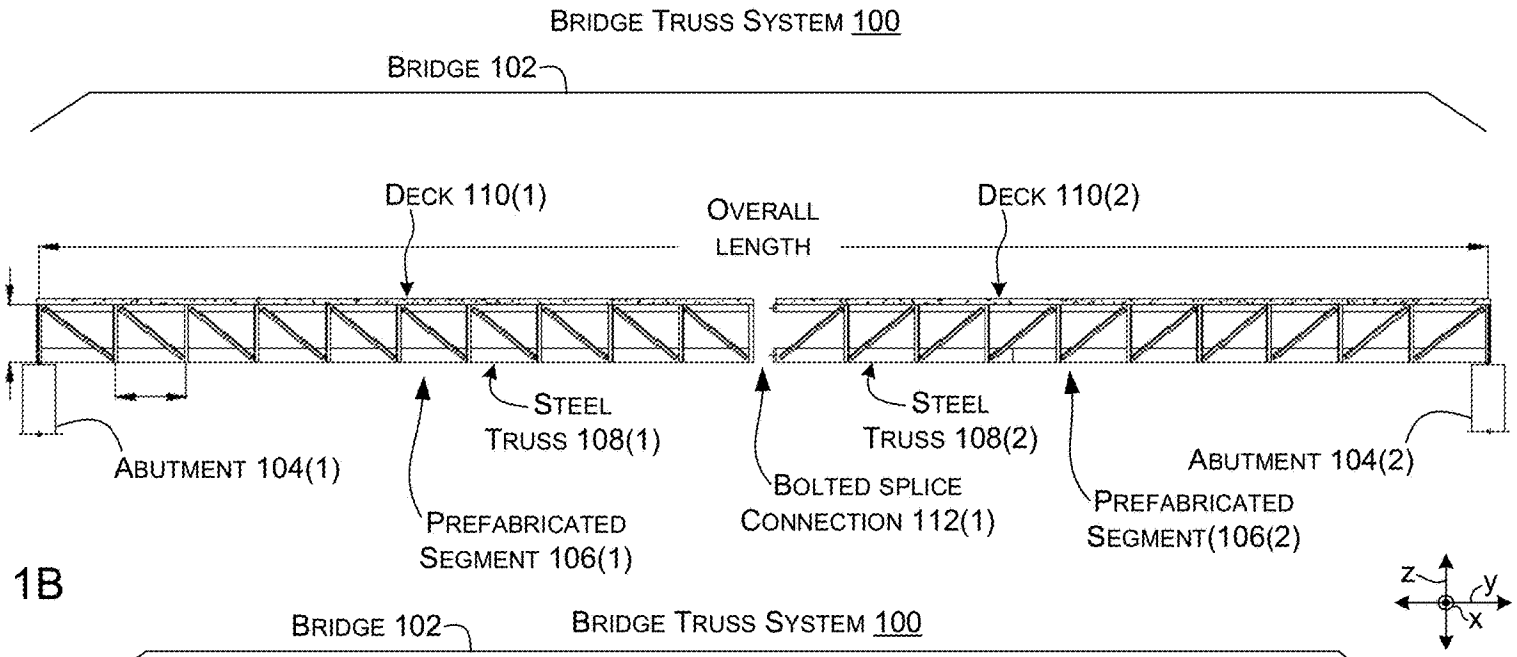
FIGS. 1B, 1C, 2A, 2B, 3, 4A, 4B, and 5 show elevational views of bridge truss system examples in accordance with some implementations of the present concepts.
Figure 1C:
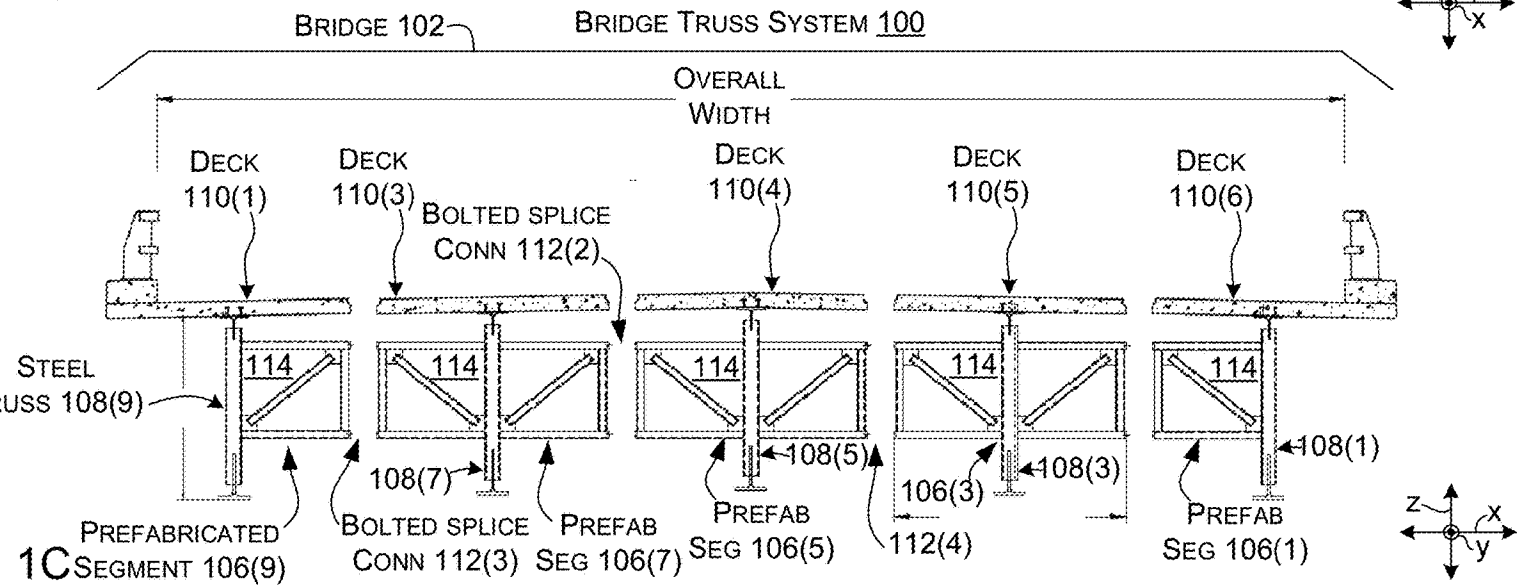

FIGS. 1A-1C collectively show example bridge truss system 100. The bridge truss system can include a bridge 102 that can be supported by abutments 104. The bridge 102 can entail multiple prefabricated segments 106. The prefabricated segments 106 can include a steel truss 108 underlying and supporting a deck 110, such as a concrete deck. Multiple prefabricated segments 106 can be secured together, such as with bolted splice connections 112 to define an overall length of the bridge 102 (FIG. 1B). Alternatively or additionally, multiple prefabricated segments can be secured together to define an overall width of the bridge (FIG. 1C).

Example implementations of the steel truss girder bridge deck system 100 can offer efficient and aesthetic options for bridge applications, such as highway crossings. Their relatively light weight compared with plate girder systems make them a desirable alternative for both material savings and constructability.

The prefabricated welded and/or bolted steel truss 108 can be the basis of a modular element (e.g., prefabricated segments 106). The prefabricated segments 106 can include the deck 110 integrated on the steel trusses 108 that are transported to the site. As illustrated in FIG. 1C, the prefabricated segments 106 may include supports 114 extending laterally that can be used to support the deck and/or for connecting the prefabricated segments together. These prefabricated segments 106 can then be transported to the site, where they can be lifted on to the bridge foundation system (e.g., abutments 104). Alternatively, the prefabricated segments 106 can be transported to the site and assembled before the deck 110 is positioned across the top of the steel trusses 108. As illustrated in FIG. 1C, supports 114 can be bolted together (e.g., bolted splice connections 112(2) and 112(3) are specifically designated) to define the overall width of the bridge. Stated another way, as shown in FIG. 1C, prefabricated segments 106 can be joined lengthwise to increase an overall width of the bridge 102.

As shown in FIG. 1B, alternatively or additionally, prefabricated segments 106 can be joined end to end, such as by bolted splice connection 112(1) to increase the overall length of the bridge 102. In this example two prefabricated segments 106(1) and 106(2) contribute to the over bridge length. In other cases, more than two prefabricated segments could be joined together to define the overall bridge length.

Truss bridges have been used in many instances in the past. However, these traditional configurations involve a through truss configuration, while the current concepts involve an underslung truss arrangement. The decks in the traditional systems do not act compositely with the trusses, while composite action between the concrete decks and steel trusses in the present systems can offer improved structural efficiency and stiffness.

The steel truss 108 can use bolted and/or welded connections at selected locations in the trusses to offer improved fatigue performance, allowing for lighter weight members (e.g., trusses compared to standard girders), and making it a viable alternative for bridge replacement projects using either conventional or accelerated construction methods.

FIGS. 2A-5 collectively show several steel truss examples.

Figure 2B:
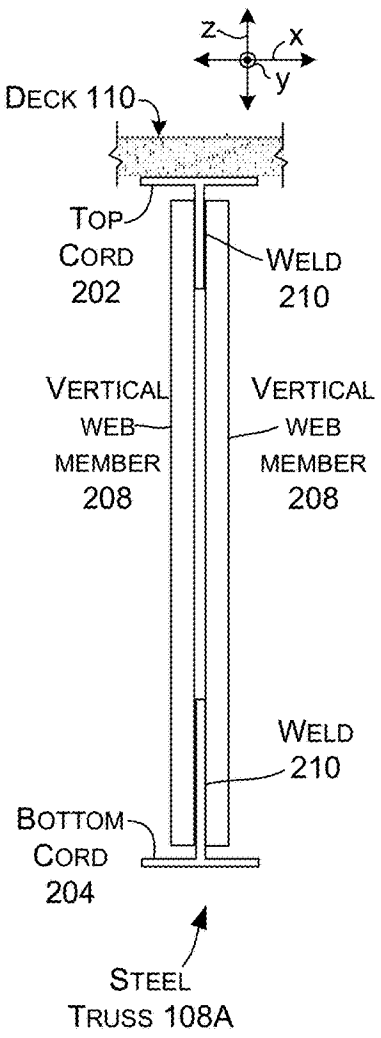
Figure 2A:
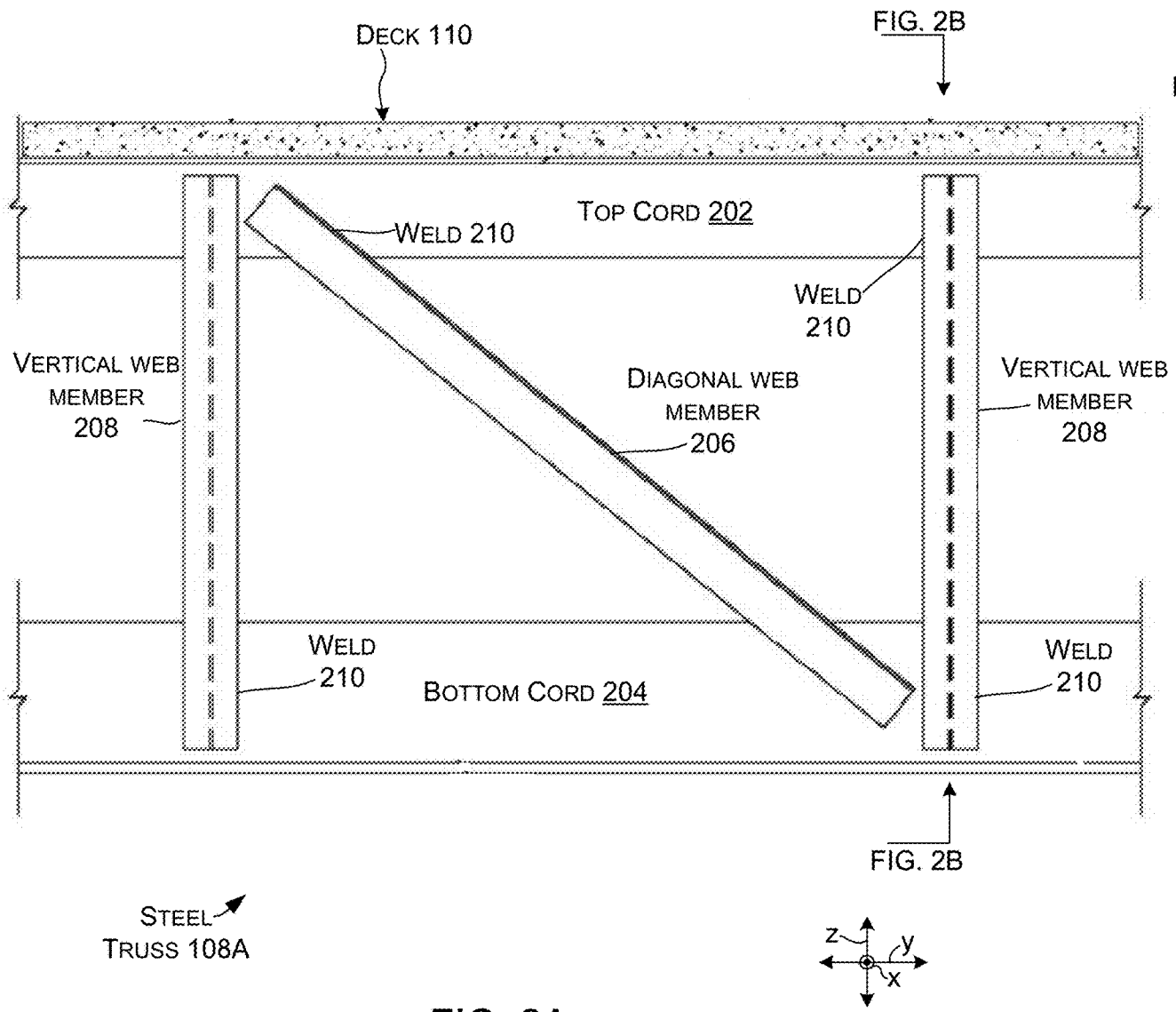

FIGS. 2A and 2B show portions of example steel truss 108A with deck 110 formed thereon. In this case, the steel truss 108 includes a top cord 202 spaced apart from a bottom cord 204. As shown in FIG. 2B, the top cord 202 can be T-shaped in cross-section and the bottom cord 204 can also be T-shaped (e.g., an inverted T-shape). Multiple diagonal web members 206 and/or vertical web members 208 can be secured to the top cord 202 and the bottom cord 204. In this implementation, the diagonal web members 206 and the vertical web members 208 can both be welded to the top cord 202 and the bottom cord 204 as indicated by welds 210. In the illustrated example as shown in FIG. 2B, the top and bottom cords are sandwiched between opposing pairs of vertical web members 206 and/or diagonal web members 208.

The diagonal web members 206 and/or vertical web members 208 can entail double channels, double angles, WT's, or hollow tube members, among others. The diagonal web member and the vertical web member may be the same type of structures (e.g., WTs) or different types of structures. In an example of the latter configuration, double angles can be used for the diagonal web members 206 and tube members for the vertical web members 208, for instance.

Figure 3:
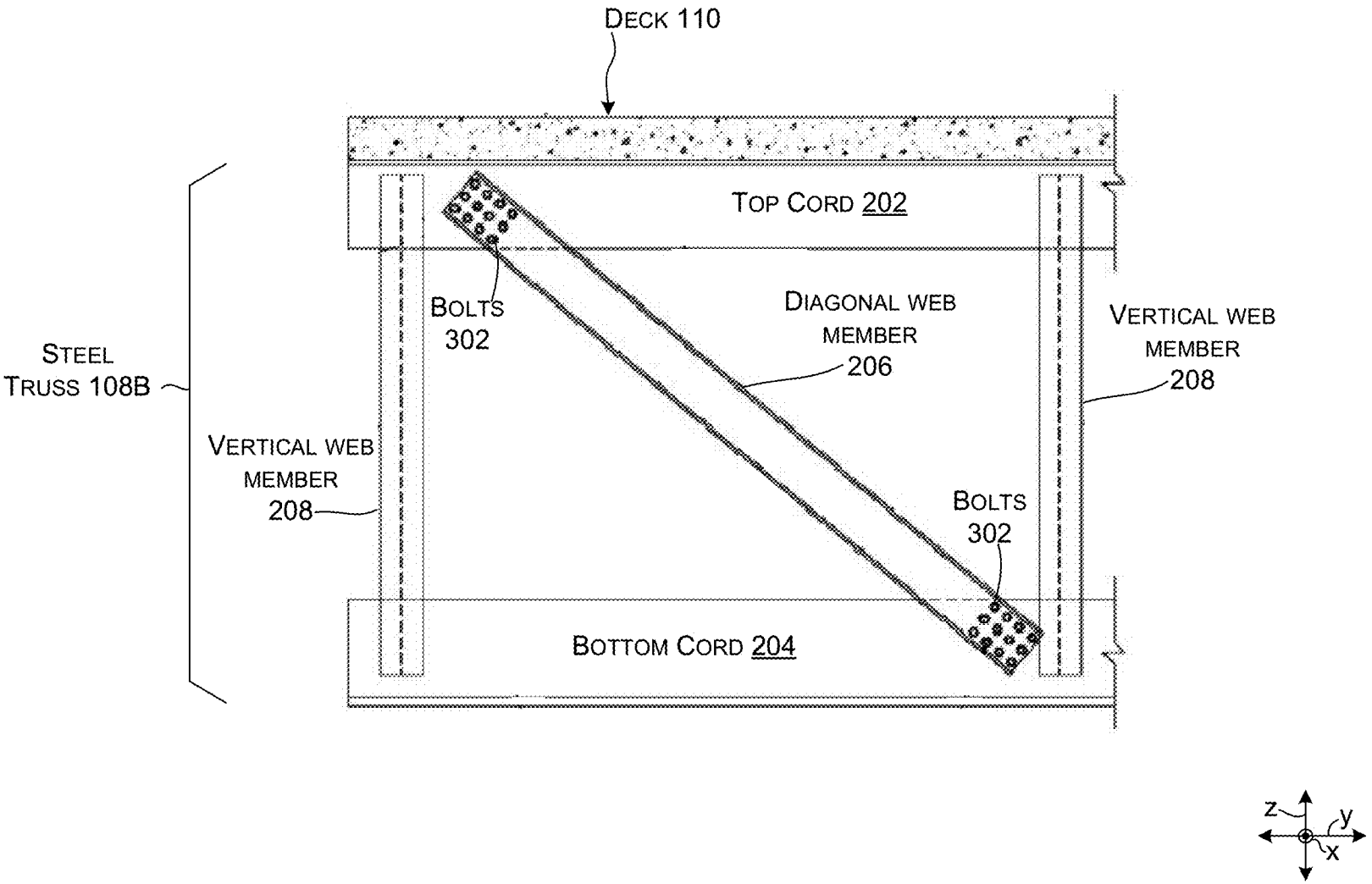

FIG. 3 shows a portion of a similar example steel truss 108B with deck 110 formed thereon. In this case, the diagonal web members 206 are bolted to the top cord 202 and the bottom cord 204 by bolts 302. The vertical web members 208 can be subject to compression and are welded to the top and bottom cord. The diagonal web members 206 maybe exposed to tension forces and the bolts 302 may be less subject to fatigue in such conditions than welds.

Figure 4B:
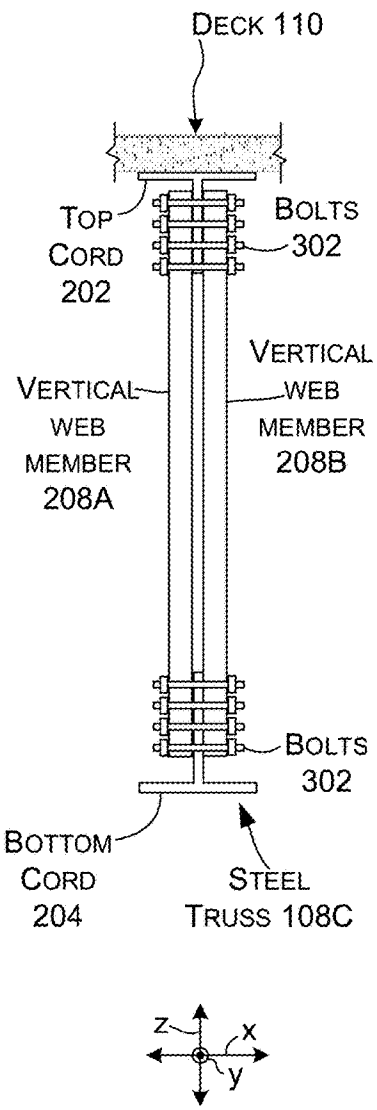
Figure 4A:
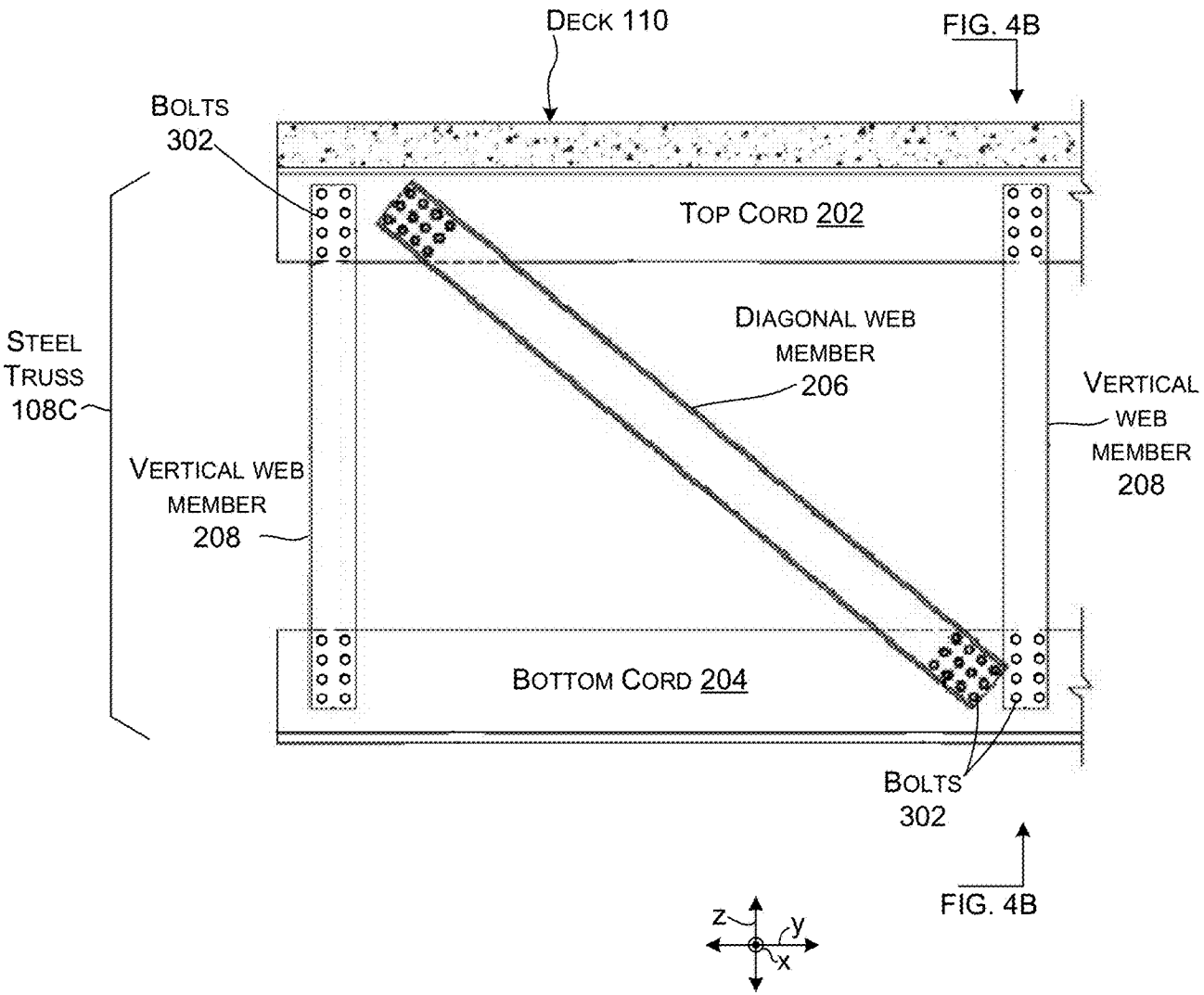

FIGS. 4A and 4B show portions of a similar example steel truss 108C with deck 110 formed thereon. In this case, both the diagonal web members 206 and the vertical web members 208 are bolted to the top cord 202 and the bottom cord 204 by bolts 302.

Figure 5:
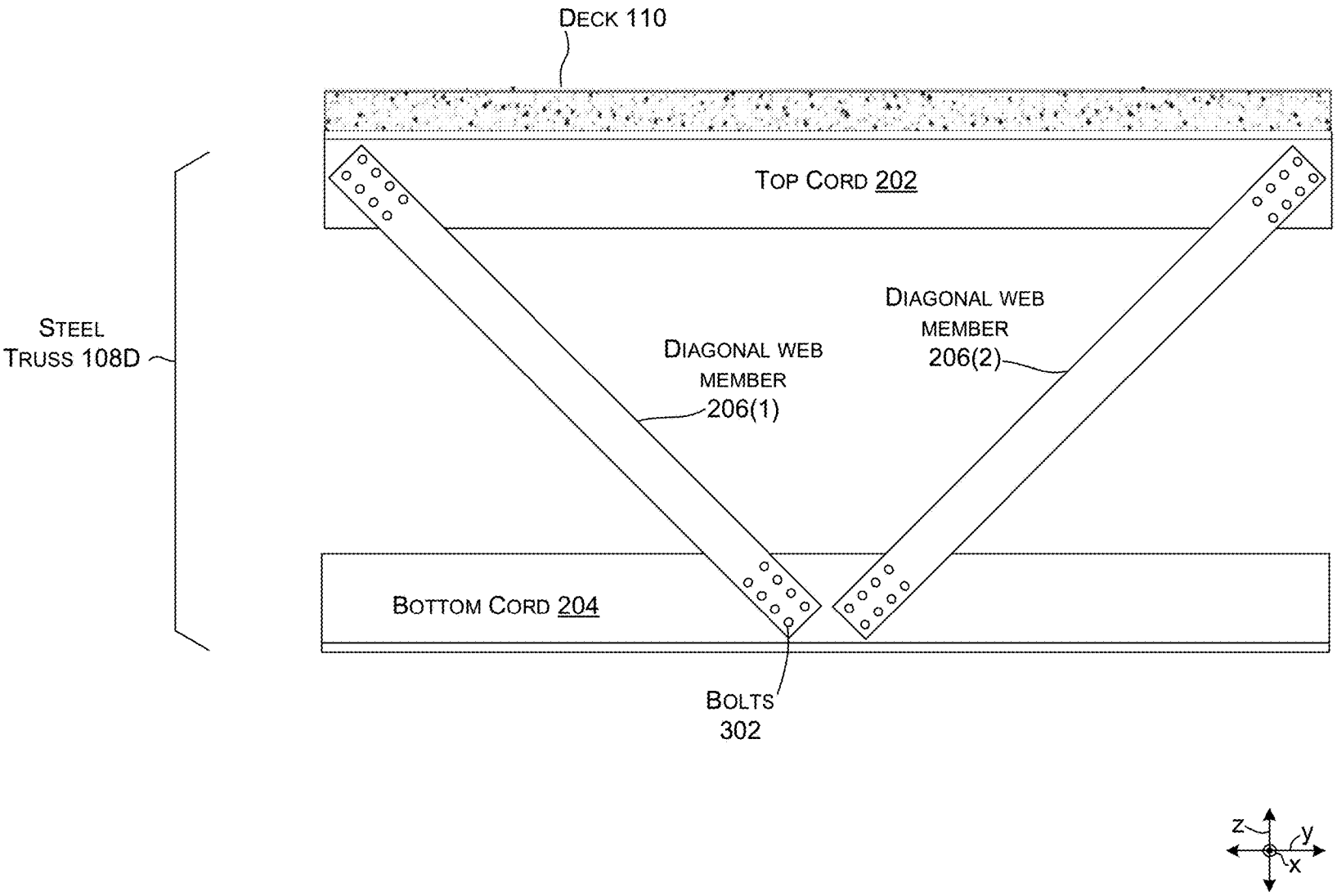

FIG. 5 shows a portion of a similar example steel truss 108D with deck 110 formed thereon. In this case, only diagonal web members 206 are employed between the top cord 202 and the bottom cord 204. In this example, the diagonal web members are bolted to the top and bottom cords by bolts 302.

As discussed above, the diagonal web members 206 and/or vertical web members 208 may be secured to the top and bottom cords 202 and 204 in the same manner or different manners. For instance, all web members could be welded to the top and bottom cords. In another case, all web members could be bolted to the top and bottom cords. Still other implementations can use other securing elements, such as rivets, among others. In still another implementation, the vertical web members can be welded while the diagonal web members are bolted. This latter configuration can provide a weight and time saving associated with welding for the vertical web members. In some implementations, fillet welds can be used to secure the vertical web members. Fillet welds may not require inspection and thus decrease cost and increase speed of assembly. Eliminating inspection can decrease overall costs associated with the fillet welds compared to other weld types. Note that in the illustrated example, the diagonal web members 206 and/or the vertical web members 208 can be secured directly to the top and bottom cords 202 and 204 (e.g., without gussets). This direct securing can provide better fatigue resistance than gusseted interfaces.

The diagonal web members 206, which are subjected to tension can be bolted to enhance durability (e.g., fatigue life). The use of bolts 302 can improve the fatigue life by eliminating the use of welds perpendicular or at steep angles to the top cord and bottom cord 202 and 204. Using bolts or other fasteners, such as rivets, for the connection of both vertical and diagonal web members to the top and bottom cords can provide fatigue performance of the connection which meets the infinite-life design requirements using AASHTO's Fatigue I load combination.

A combination of bolted and welded connections for the truss web members 206 and 208 to the truss top and bottom chords 202 and 204 are adequate for a finite-life design of 75-years using the Fatigue II load combination threshold of 6.4 ksi. This connection configuration provides adequate life for lower traffic volume bridges such as secondary roads, county roads, and limited access roads.

Material and fabrication cost estimates suggest the welded and bolted steel truss girder options cost approximately 5% to 20% less than a comparable plate girder.

Materials and fabrication estimates suggest the cost of the conventional and accelerated construction methods utilizing the prefabricated steel trusses is 10% and 26% less, respectively, than plate girders of similar spans. An additional savings associated with the present steel truss implementations can be the elimination of the required weld inspections for the full penetration welds between shop splices in the flange and the web of a traditional plate girder.

The steel truss 108 can be formed in various ways. One method is to split an I beam or WT beam along the web to create the top cord 202 and the bottom cord 204. If desired beam sizes are not available, "T" shaped top and bottom cords can be fabricated using two plates that are oriented orthogonally to one another in the T shape and welded longitudinally. Further, camber can be imparted on the T shaped top and bottom cords during manufacturing of the steel truss. The camber will then be imparted to the finished steel truss when the diagonal and vertical members are secured. This is superior to heat curving that is used to impart camber to traditional steel girders. The steel trusses are lighter weight than steel girders on an equivalent strength basis and thus yield significantly lower transportation and erection costs and overall project costs.

CONCLUSION

Although techniques, methods, devices, systems, etc., pertaining to steel truss bridge implementations are described in language specific to structural features and/or methodological acts, it is to be understood that the subject matter defined in the appended claims is not necessarily limited to the specific features or acts described. Rather, the specific features and acts are disclosed as exemplary forms of implementing the claimed methods, devices, systems, etc.

The invention claimed is:

1. A bridge, comprising:

a steel truss comprising a unitary T-shaped steel top cord spaced away from an inverted unitary T-shaped steel bottom cord of equal length as the T-shaped steel top cord and multiple tensioned diagonal web members bolted directly to the T-shaped steel top cord and the inverted T-shaped steel bottom cord and multiple pairs of vertical web members interposed between the multiple tensioned diagonal web members and welded directly to the T-shaped steel top cord and the inverted T-shaped steel bottom cord to sandwich the T-shaped steel top cord and the inverted T-shaped steel bottom cord between the multiple pairs of vertical web members; and, a concrete deck integrated with the T-shaped steel top cord of the steel truss.

2. The bridge of claim 1, wherein the steel truss comprises multiple parallel steel trusses.

3. The bridge of claim 1, wherein the steel truss comprises a first steel truss that abuts and is bolted to a second steel truss to define a length of the bridge.

* * * * *